United States Patent [19]

Wolf

[11] 4,114,699

[45] Sep. 19, 1978

[54] PNEUMATIC ROTARY HAMMER DEVICE

[75] Inventor: Otto Wolf, Kirchheim, Teck, Germany

[73] Assignee: Licentia Patent-Verwaltungs-GmbH, Frankfurt am Main, Germany

[21] Appl. No.: 760,656

[22] Filed: Jan. 19, 1977

[30] Foreign Application Priority Data

Jan. 22, 1976 [DE] Fed. Rep. of Germany ..... 2602239
Jan. 22, 1976 [DE] Fed. Rep. of Germany ..... 7601636

[51] Int. Cl.[2] ..... B25D 9/00

[52] U.S. Cl. ..... 173/109; 173/29; 173/118

[58] Field of Search ..... 173/14, 116, 118, 109

[56] References Cited

U.S. PATENT DOCUMENTS

| | | | |
|---|---|---|---|
| 3,559,751 | 2/1971 | Yamada | 173/118 X |
| 3,766,990 | 10/1973 | Eckman et al. | 173/12 |
| 3,828,863 | 8/1974 | Bleicher et al. | 173/118 X |
| 3,828,865 | 8/1974 | Schnizler | 173/109 X |
| 3,837,409 | 9/1974 | Consoli et al. | 173/118 X |
| 3,929,195 | 12/1975 | Stiltz et al. | 173/116 X |

FOREIGN PATENT DOCUMENTS

| | | | |
|---|---|---|---|
| 2,326,087 | 12/1974 | Fed. Rep. of Germany | 173/109 |
| 563,845 | 7/1975 | Switzerland | 173/118 |

*Primary Examiner*—Lawrence J. Staab
*Attorney, Agent, or Firm*—Spencer & Kaye

[57] ABSTRACT

A hammer drill has a motor-actuated drive piston and a free percussion body accommodated in a common, stationary cylinder. The percussion body is caused to move back and forth by the drive piston with air as the coupling and buffer medium. The hammer drill further has a tool holder driven by a hollow drive shaft which encloses the stationary cylinder and is driven by a motor which also actuates the drive piston.

5 Claims, 3 Drawing Figures

PNEUMATIC ROTARY HAMMER DEVICE

BACKGROUND OF THE INVENTION

Pneumatic hammer drills are known in which driving and percussion elements constituted by a motor-actuated drive piston and a freely moving percussion body, respectively, are accommodated in a rotating cylinder. The percussion body is caused to move back and forth with air acting as the coupling and buffer medium and further, the percussion body is controlled by means of a venting port disposed in the wall of the cylinder in the region of the pneumatic buffer. The rotating cylinder simultaneously serves to drive the tool holder which is fastened to the sleeve via an insert. Such an arrangement is disclosed in German Laid-Open Application (Auslegeschrift) No. 1,427,747. Due to the relative movement of the rotating cylinder with respect to the solely axially moving drive piston as well as with respect to the percussion body, there results, on the one hand, greater wear of the parts which move relative to one another and, on the other hand, sealing problems develop since sufficient play must be provided for rotation of the piston relative to the axially moving driving and percussion elements. Further the efficiency of the hammer drill is adversely affected by increased friction losses in the percussion mechanism. The consequence of reduced tightness between the inner wall of the cylinder and the parts of the drive piston and percussion body coming in contact therewith is that between two operating strokes the amount of air flowing through the venting port provided in the cylinder in the region of the buffer zone is no longer sufficient to make up for the leakage losses. Thus the striking effect of the hammer is reduced; furthermore, it may happen that the percussion body hits the drive piston. This is objectionable since it may damage, or even destroy the percussion system.

SUMMARY OF THE INVENTION

It is an object of the present invention to provide a hammer drill in which the described drawbacks are avoided and which provides comparatively more favorable conditions regarding operational dependability, striking effect and efficiency and additionally makes possible an economical manufacture.

This object and others to become apparent as the specification progresses, are accomplished by the invention, according to which, briefly stated, the cylinder which accommodates the drive piston and the freely moving percussion body is stationary and a hollow shaft, which encloses the stationary cylinder and is driven by the motor actuating the drive piston, is provided as the drive shaft for the tool holder.

In addition to the above-listed advantages, this measure eliminates the need for a special tool adapter shaft which is spaced at a distance from the cylinder, as well as the associated bearings and other parts which are conventionally used and required to drive a spindle sleeve.

According to a further feature of the invention, the venting port in the cylinder opens into a closed chamber and the walls of the hollow shaft are used at least as part of the walls that define the chamber. By forming a closed-chamber system which is in communicating connection with the venting port or ports provided in the region of the buffer zone in the stationary cylinder and encloses further air outlet and inlet bores provided in the cylinder or adjacent thereto and required for proper operation, an optimum hammering effect can be realized particularly when the venting port in the buffer region is spaced sufficiently from the region of the front dead center position of the drive piston. On the other hand, it is also feasible to leave but a small space between the hollow shaft and the cylinder and to provide the cylindrical surface of the hollow shaft with air ports which cooperate with those in the cylinder in such a manner that perfect hammer and/or drill operation becomes possible. In this case it is of advantage for the space surrounding the hollow shaft to be in communication with the outer atmospheric air.

According to a further feature of the invention, the hollow shaft is provided with a toothed gear or with teeth in its end region on the drive side. The gear is in engagement with a drive gear disposed on an intermediate shaft which is also caused to rotate by the drive motor, if necessary through the intermediary of a stepping gear.

DESCRIPTION OF THE PREFERRED EMBODIMENT

Figure 1:
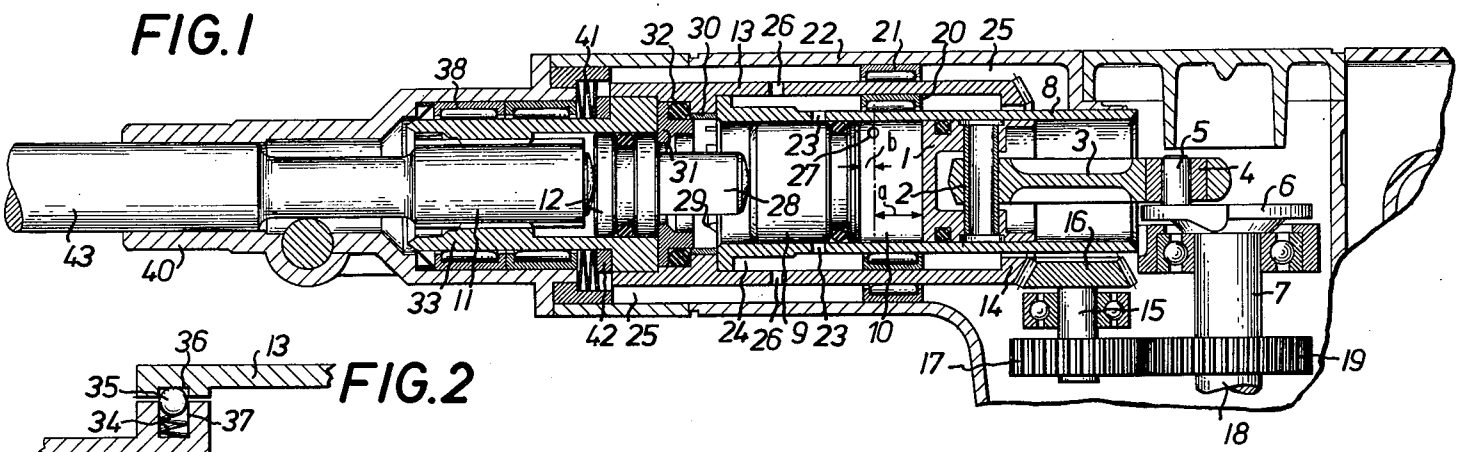
FIG. 1 is a longitudinal sectional view of a preferred embodiment of the invention.

As can be seen in FIG. 1, the work piston or drive piston 1 is driven by a connecting rod 3 which engages a wrist pin 2. Into the rearward bearing 4 of the connecting rod 3 projects an eccentric pin 5 of a crank 6 whose shaft 7 is coupled to the drive shaft 18 of the drive motor (not illustrated). The work piston 1 is received in a stationary cylinder 8 which also accommodates a freely movable percussion body 9. Work piston 1 and percussion body 9 are in interaction via a pneumatic buffer zone 10 such that the percussion body, after it has abutted on an anvil 12 which acts upon the shaft 11 of a tool or tool holder, as the case may be, follows the return movement of the work piston with a delay and reverses its direction of movement only when the air in the buffer zone 10 has been compressed during the progressing work stroke of the work piston to such an extent that the pressure acting on the percussion body accelerates it toward the tool shaft.

The cylinder 8 is concentrically enclosed by a hollow shaft 13 which is provided at its end on the drive side with a bevel gear 14 meshing with a bevel drive gear 16 disposed on an intermediate shaft 15. The bevel drive gear 16 is connected, via an intermediate gear 17, with a gear 19 attached to the drive shaft 18 of the motor (not illustrated). The hollow shaft 13 is mounted on cylinder 8 by means of pin or ball bearings 20 for simple or multiple rotation and is supported by a housing jacket 22 by the intermediary of a bearing 21.

The hollow shaft 13 may be provided with air equalization or air passage openings 26. Between cylinder 8 and hollow shaft 13, a space is provided which constitutes a chamber 24. The latter, if air equalizing openings 26 are provided, is in communication with a space 25 which is adjacent hollow shaft 13. Chamber 24 and/or space 25 may be sealed from the remainder of the hammer drill by suitable measures such that no exchange of air is possible with the outside atmosphere as well as with the region of the hammer drill including all or at least part of the drive arrangement. This also assures, among others, that there will be no appreciable lubricant losses. It is also readily feasible, however, if required, to make chamber 24 and/or space 25 accessible to the outside atmosphere.

The wall of the cylinder 8 is provided with venting ports 23 and 27 which, controlled by the percussion body 9, effect a flow connection from the buffer zone 10 to the chamber 24. During the time when venting port 27 is not covered by percussion body 9, air can flow through this opening from chamber 24 or into it, depending on whether the drive piston, at that time, is performing a compression stroke or an expansion stroke (return stroke). The venting port 27 disposed in the cylinder 8 in the region of the buffer zone 10 is arranged at such a distance *a* from the foremost dead center position of the drive piston 1 or at a corresponding distance *b* from the rearward face of the percussion body 9 when the latter is in its striking position, that the "replenishment period" during the return movement of the drive piston 1 is dimensioned sufficiently to positively prevent an impact of the percussion body 9 on the drive piston 1 and to assure an optimum striking effect.

The venting ports 23 become effective when the percussion mechanism is rendered inactive. For this purpose, either a tool with a shorter shaft is introduced into the tool holder or the tool holder together with the tool is brought forward into an arrested position by means of a setting sleeve against the force of a return spring to such an extent that shaft 28 of anvil 12 which is guided in hollow shaft 13 can move out of cylinder 8. Thus, percussion body 9 is moved forward to such an extent that the venting ports 23 are exposed. As a result, pneumatic pressure can no longer be built up in the cylinder so that the hammering effect is eliminated and the tool only performs a rotary movement. The air displaced by percussion body 9 during hammer drill operation passes into chamber 24 through recesses 29 provided in a centering disc 30 bordering on the frontal face of cylinder 8 and, during the return movement of the percussion body 9, from the chamber 24 back to the front region of the cylinder due to the then forming subatmospheric pressure and thus aids the return movement of the percussion body 9.

The numeral 31 identifies an abutment disc. An O ring 32 provided between centering disc 30 and abutment disc 31 serves as a damper and as a seal.

The hollow shaft 13 is coupled with the tool holder constituted by a spindle sleeve 33. For this purpose the hollow shaft may be provided with longitudinal teeth (splined shaft profile), which are in engagement with corresponding teeth of the spindle sleeve. It has been found to be of particular advantage to provide a safety coupling between the spindle sleeve 33 and the hollow shaft 13 for preventing rotary movement of the spindle sleeve if the tool jams.

Figure 2:
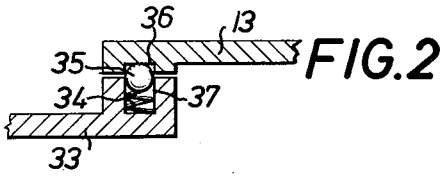
FIG. 2 is a sectional view of the coupling between two parts of the same embodiment.

As can be seen in FIG. 2, the safety coupling may be formed, for example, by a spring-ball arrangement 34, 35, in which, for example, three balls 35 which are distributed over the periphery, engage in recesses 36 in hollow shaft 13. The recesses are designed to conform to shape and prevailing loads. The associated springs 34 are seated in bores 37 of spindle sleeve 33. Expediently, the safety coupling may be of adjustable design.

Figure 3:
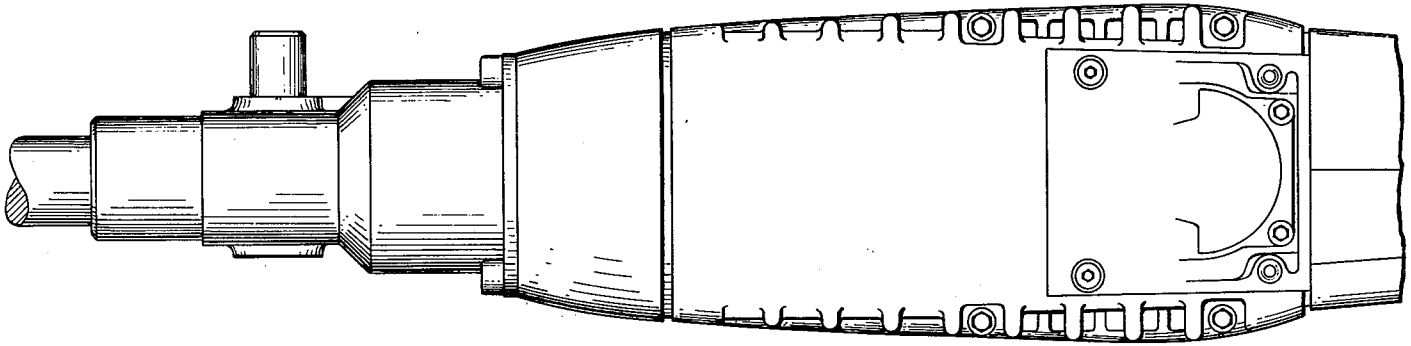
FIG. 3 is a top plan view of the same embodiment.

The spindle sleeve 33 is rotatably mounted in the stationary tool receiving part 40 of the hammer housing by means of roller bearings 38. Disc spring 41 and a spacer disc 42 are provided for the purpose of damping the stroke which is exerted at the end of the drilling process by the percussion body 9 via abutment disc 31 on the spindle sleeve 33 holding the tool 43. FIG. 3 shows the handy exterior design of the hammer according to the invention.

In some cases, anvil 12 may be omitted and instead the shaft 11 of the tool or of the tool carrier 43, as the case may be, may be lengthened correspondingly. In order to assure that, if required, the zone of chambers 24 and 25 on the drive side participates in the exchange or equalization of the air, as the case may be, the walls of hollow shaft 13 and/or of cylinder 8 may also be provided with passage slits or the like along their zones adjacent bearings 20, 21. Such slits could alternatively or additionally be provided in the cages or rings of bearings 20, 21.

With suitable selection of the transmission ratios it is feasible to obtain without difficulty, if required, a number of revolutions for the hollow shaft 13 that differs from that of the shaft 7.

It will be understood that the above description of the present invention is susceptible to various modifications, changes and adaptations, and the same are intended to be comprehended within the meaning and range of equivalents of the appended claims.

What is claimed is:

1. In a hammer drill having a housing; a drive means supported in the housing; a cylinder supported in the housing; a drive piston received for reciprocation in the cylinder and being connected to the drive means for actuation by the drive means; a percussion body received for reciprocation in the cylinder; means defining an air cushion in the cylinder between the drive piston and the percussion body for driving the percussion body by the drive piston by the intermediary of the air cushion; and a tool holder supported in the housing and exposed to the impacting effect of the percussion body; the improvement comprising (a) means for stationarily affixing said cylinder to said housing;

(b) a hollow drive shaft rotatably supported in said housing and surrounding said cylinder and being connected to said tool holder;

(c) said drive means including (1) an intermediate shaft rotatably supported in said housing;

(2) a drive gear affixed to said intermediate shaft;

(3) a driven gear affixed to said hollow drive shaft; said drive gear meshing with said driven gear for continuously rotating said hollow drive shaft during actuation of said drive piston by said drive means;

(d) means defining air equalization ports in said hollow shaft;

(e) means defining air ports in said cylinder in the zone of said air cushion; said air ports cooperating with said air equalization ports; and (f) a safety coupling connecting said hollow shaft with said tool holder.

2. Hammer drill according to claim 1 wherein the hollow shaft (13) has a closed cylindrical surface and forms at least part of the delimiting walls of a closed chamber.

3. A hammer drill as defined in claim 1, wherein said hollow shaft and said cylinder are arranged concentrically to one another and wherein said hollow shaft and said cylinder define a space between themselves.

4. A hammer drill as defined in claim 1, said drive means further comprising a first spur gear affixed to said intermediary shaft; a motor shaft supported in said housing and a second spur gear connected to said first spur gear.

5. A hammer drill as defined in claim 1, wherein said driven gear is a bevel ring gear forming an integral part of said hollow drive shaft and said drive gear is a bevel drive gear; said bevel ring gear and said bevel drive gear forming a bevel gear drive.

* * * * *